US008012068B1

(12) United States Patent
Malcolm

(10) Patent No.: US 8,012,068 B1
(45) Date of Patent: Sep. 6, 2011

(54) CUSHIONED TREADMILL

(76) Inventor: Hopeton C. Malcolm, Brooklyn, NY (US)

( * ) Notice: Subject to any disclaimer, the term of this patent is extended or adjusted under 35 U.S.C. 154(b) by 0 days.

(21) Appl. No.: 12/970,096

(22) Filed: Dec. 16, 2010

(51) Int. Cl.
*A63B 22/02* (2006.01)

(52) U.S. Cl. ..... 482/54

(58) Field of Classification Search ..... 482/51, 482/54, 140, 23, 148
See application file for complete search history.

(56) References Cited

U.S. PATENT DOCUMENTS

| | | | | |
|---|---|---|---|---|
| 4,146,222 | A * | 3/1979 | Hribar | 482/51 |
| 5,072,928 | A | 12/1991 | Stearns et al. | |
| 5,279,528 | A * | 1/1994 | Dalebout et al. | 482/54 |
| 5,378,213 | A | 1/1995 | Quint | |
| 5,658,226 | A | 8/1997 | Mentz | |
| 5,827,155 | A | 10/1998 | Jensen et al. | |
| 6,174,267 | B1 | 1/2001 | Dalebout et al. | |
| D453,948 | S | 2/2002 | Cutler | |
| 6,520,891 | B1 * | 2/2003 | Stephens, Jr. | 482/54 |
| 6,945,913 | B2 * | 9/2005 | Moore et al. | 482/54 |
| 7,335,146 | B2 | 2/2008 | Gerstung | |
| 7,510,511 | B2 | 3/2009 | von Detten | |
| 2004/0192511 | A1 * | 9/2004 | Ein-Gal | 482/54 |
| 2009/0181829 | A1 | 7/2009 | Wu | |

* cited by examiner

*Primary Examiner* — Stephen Crow

(57) ABSTRACT

A cushioned treadmill is provided for cushioning impact between a runner's feet and the treadmill platform. The cushioned treadmill includes a base and a platform coupled to the base. The platform has a first side and a second side. A belt assembly is coupled to and extends between the first side and the second side of the platform. The belt assembly includes a movable belt forming a running surface designed for supporting a user on the platform. A cushioning material is contained in a flexible bladder positioned in the platform beneath the running surface.

16 Claims, 4 Drawing Sheets

CUSHIONED TREADMILL

BACKGROUND OF THE DISCLOSURE

Field of the Disclosure

The disclosure relates to treadmill devices and more particularly pertains to a new treadmill device for cushioning impact between a runner's feet and the treadmill platform by providing a bladder within the platform structure beneath the treadmill belt.

SUMMARY OF THE DISCLOSURE

An embodiment of the disclosure meets the needs presented above by generally comprising a base and a platform coupled to the base. The platform has a first side and a second side. A belt assembly is coupled to and extends between the first side and the second side of the platform. The belt assembly includes a movable belt forming a running surface designed for supporting a user on the platform. A cushioning material is contained in a flexible bladder positioned in the platform beneath the running surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
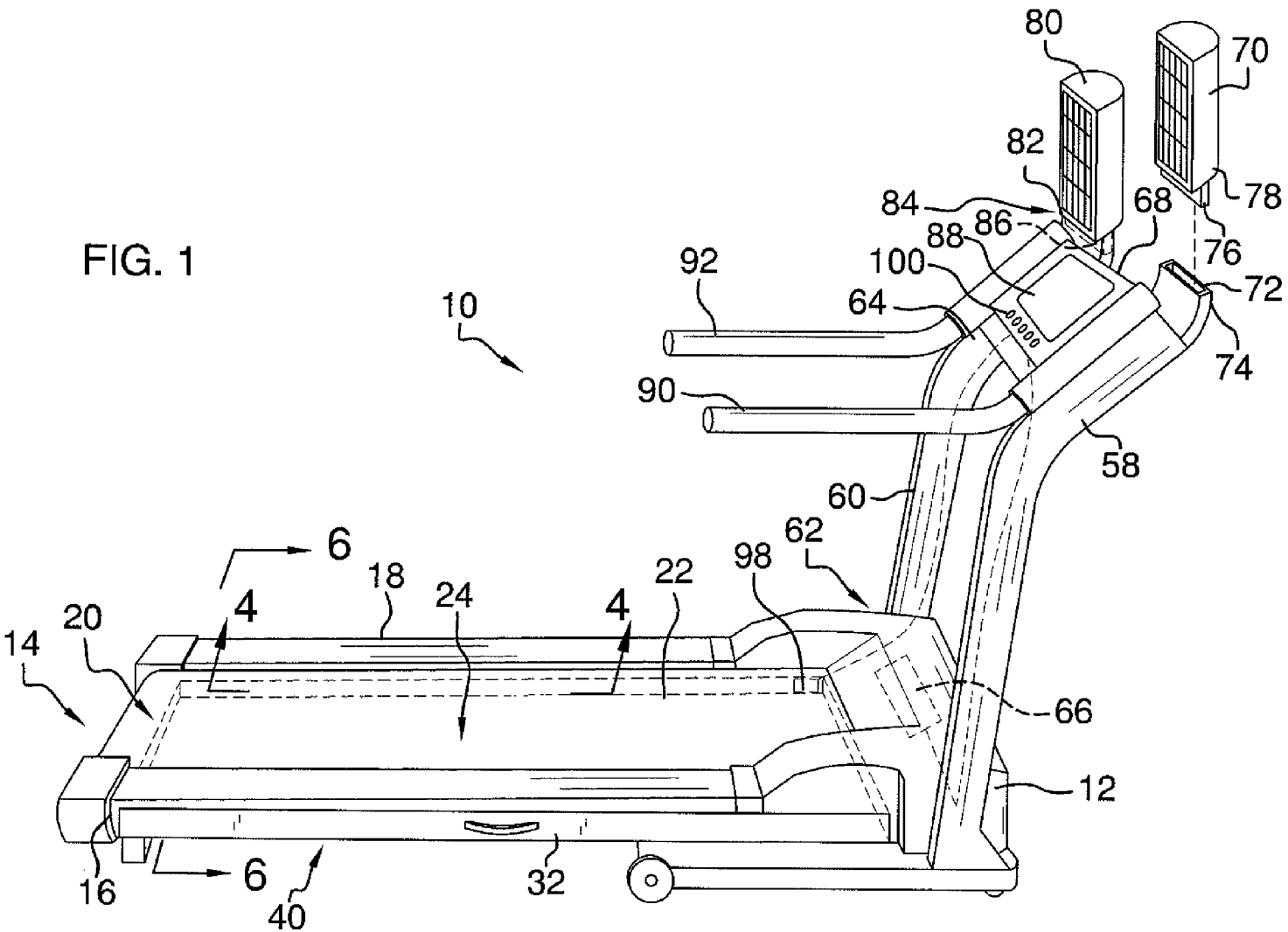
FIG. 1 is a top side perspective view of a cushioned treadmill according to an embodiment of the disclosure.
Figure 2:
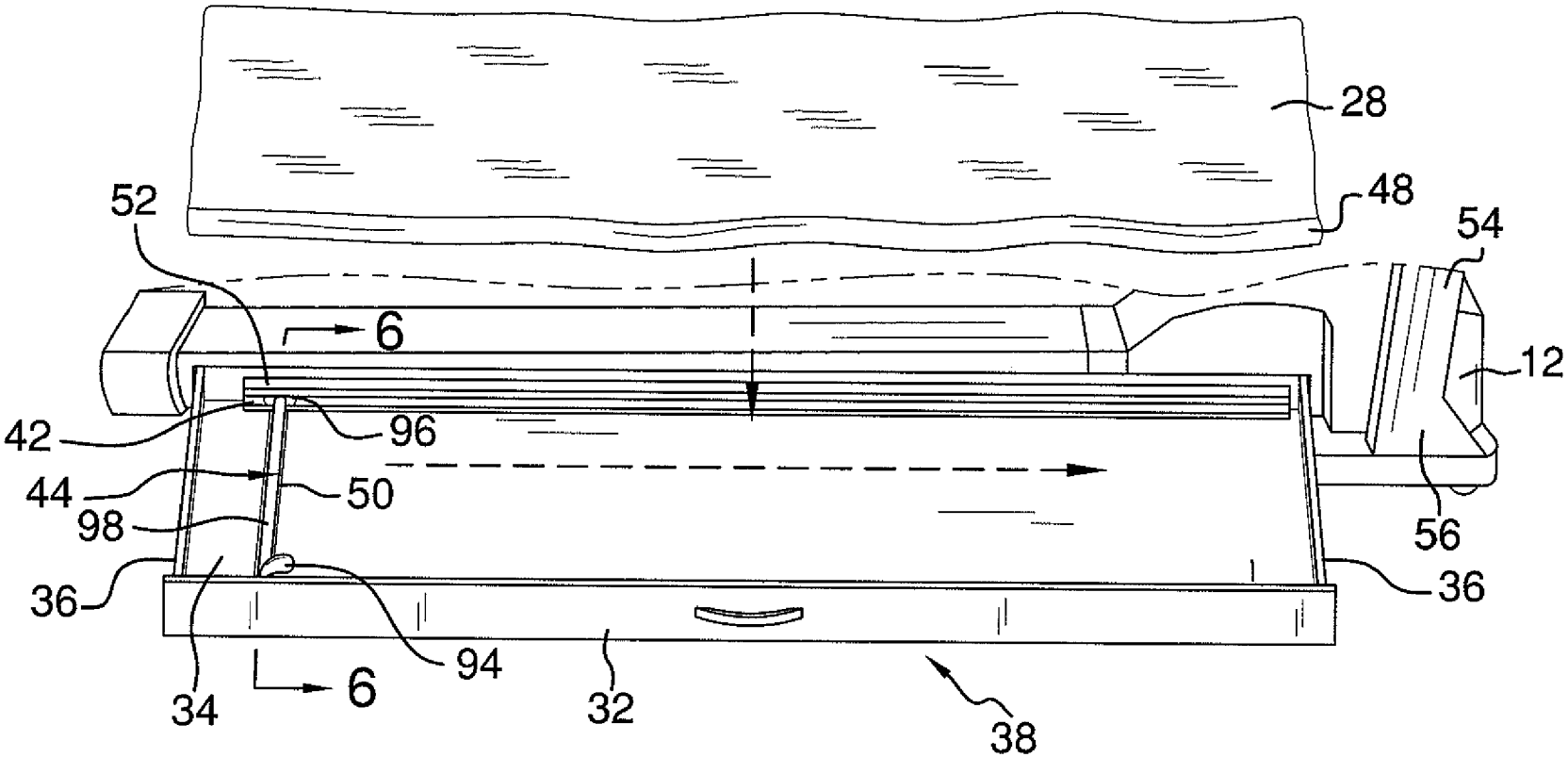
FIG. 2 is a partially exploded top side view of an embodiment of the disclosure.
Figure 3:
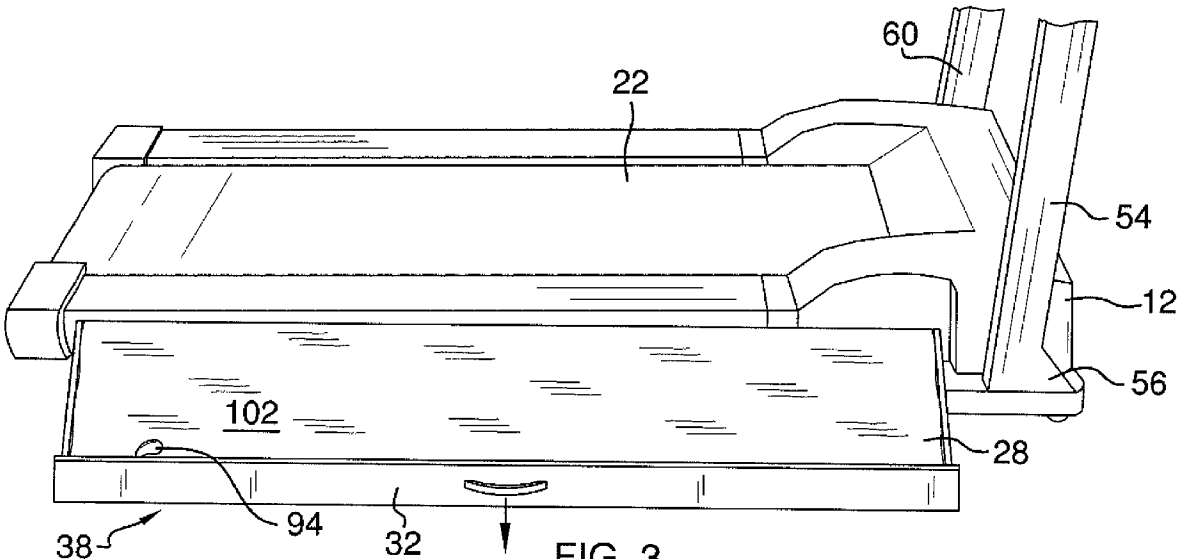
FIG. 3 is a top side view of an embodiment of the disclosure.
Figure 4:
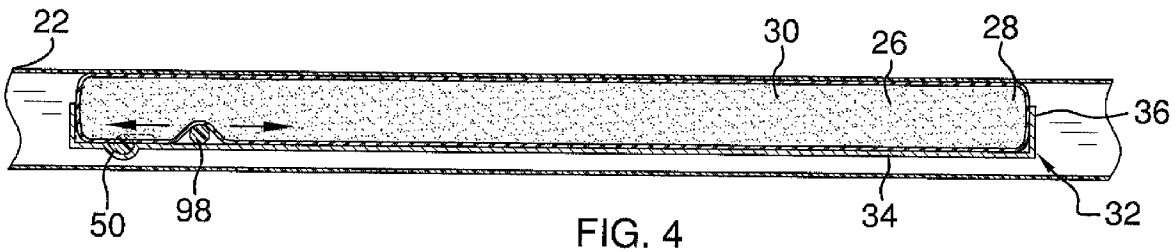
FIG. 4 is a cross-sectional view of an embodiment of the disclosure taken along line 4-4 of FIG. 1.
Figure 5:
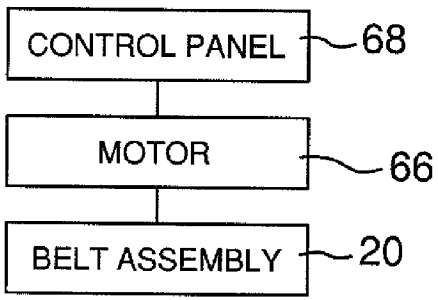
FIG. 5 is a schematic diagram of an embodiment of the invention.

With reference now to the drawings, and in particular to FIGS. 1 through 6 thereof, a new treadmill device embodying the principles and concepts of an embodiment of the disclosure and generally designated by the reference numeral 10 will be described.

As best illustrated in FIGS. 1 through 6, the cushioned treadmill 10 generally comprises a base 12 and a platform 14 coupled to the base 12. The platform 14 has a first side 16 and a second side 18. A belt assembly 20 is coupled to and extends between the first side 16 and the second side 18 of the platform 14. The belt assembly 20 includes a movable belt 22 forming a running surface 24 designed for supporting a user on the platform 14. A granular cushioning material 26 is contained in a flexible bladder 28. The bladder 28 is positioned in the platform 14 beneath the running surface 24. Using sand 30 in the bladder 28 simulates the experience of running on sand.

A drawer 32 is provided having a bottom 34 and a perimeter wall 36 extending upwardly from the bottom 34. The drawer 32 is coupled to the first side 16 of the platform 14. The bladder 28 is positionable in the drawer 32. The bladder 28 is also configured to rest against the perimeter wall 36 of the drawer 32 to provide lateral support to the bladder 28 during use. The drawer 32 is slidable between an open position 38 providing access to the bladder 28 and a closed position 40 wherein the bladder 28 is positioned beneath the running surface 24.

A track 42 is coupled to the drawer 32. The track 42 extends along a length of the drawer 32. A roller assembly 44 is coupled to the track 42 and extends across the bottom 34 of the drawer 32. The roller assembly 44 is movable along the track 42 beneath the bladder 28 to enhance even distribution of the cushioning material 26 within the bladder 28. A handle 94 extends from a distal end 46 of said roller assembly 44 relative to the track 42. The handle 94 is structured for positioning adjacent to a forward edge 48 of the bladder 28 to slide along the forward edge 48 of the bladder 28 to facilitate manipulation of the roller assembly 44 to move the roller assembly 44 in the track 42. The handle 94 further extends upwardly and is configured to have an upper end 100 that extends upwardly from a top surface 102 of the bladder 28 to facilitate grasping of the handle 94. A recess 50 may be positioned in the bottom 34 of the drawer 32. The recess 50 extends transversely from an end 52 of the track 42. The roller assembly 44 is storable in the recess 50 while the user runs on the running surface 26.

Figure 6:
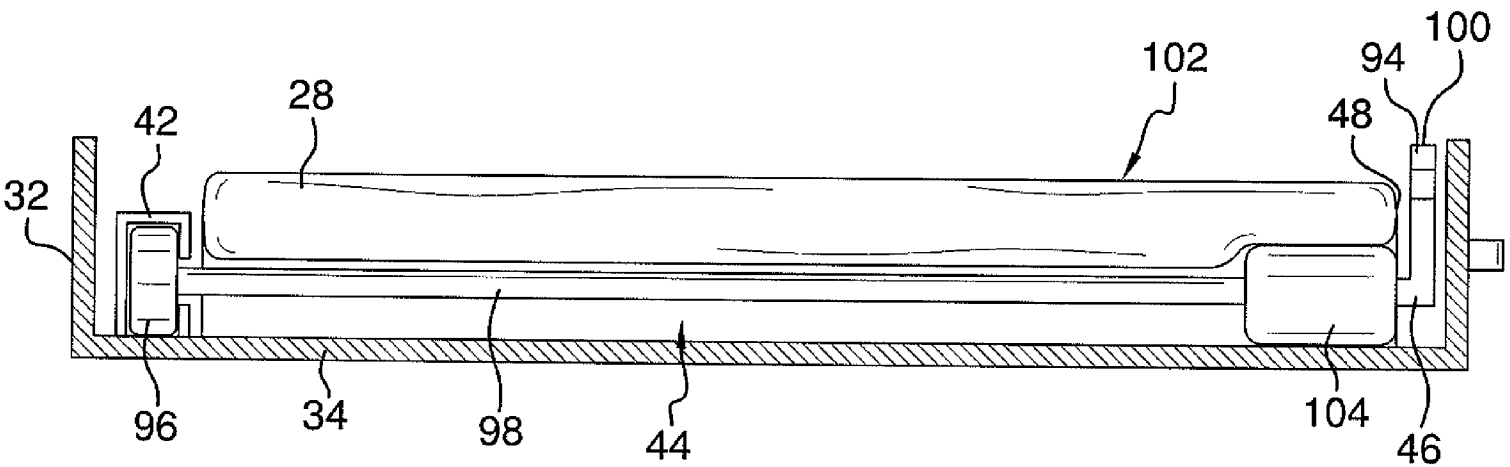
FIG. 6 is a cross-sectional view of an embodiment of the disclosure taken along line 6-6 of FIG. 3.

As shown in FIG. 6, the roller assembly 44 includes a wheel 96 positioned in the track 42. A rod 98 extends from the wheel 96. A roller 98 is coupled to the rod 98 adjacent to the handle 94. The roller assembly 44 may also be motorized to move said wheel 96 in said track 42.

A first support 54 has an angled medial section 58 and a lower end 56 coupled to the base 12. The first support 54 extends upwardly from the base 12. A second support 60 has an angled medial section 64 and a lower end 62 coupled to the base 12. The second support 60 extends upwardly from the base 12. A motor 66 is positioned in the base 12 and operationally coupled to the belt assembly 20. A control panel 68 is operationally coupled to the motor 66 for controlling the belt assembly 20. The control panel 68 is structurally coupled to the first support 54 and the second support 60. For better access during use, the control panel 68 extends between the angled medial section 58 of the first support 54 and the angled medial section 64 of the second support 60. The control panel 68 may also be operationally coupled to the roller assembly 44 to permit operation of the roller assembly 44 by pushing a button on the control panel 68.

A first fan 70 is coupled to the first support 54. The first fan 70 is designed for directing air towards the user while the user is supported on the platform 14. The first fan 70 is selectively removable from the first support 54 if desired. A slot 72 is positioned in a top 74 of the first support 54. A tab 76 extends from a bottom 78 of the first fan 70. The tab 76 extending from the bottom 78 of the first fan 70 is insertable into the slot 72 in the top 74 of the first support 70 to support the first fan 70 on the top 74 of the first support 70 in a stable position. Similarly, a second fan 80 is coupled to the second support 60. The second fan 80 is also designed for directing air towards the user while the user is supported on the platform 14. The second fan 80 is selectively removable from the second support 60. A slot 82 is positioned in a top 84 of the second support 60. A tab 86 extends from a bottom 88 of the second fan 80. The tab 86 on the bottom 88 of the second fan 80 is insertable into the slot 82 of the second support 60 to support the second fan 80 on the top 84 of the second support 60 in a stable position.

A first handlebar 90 extends outwardly from the first support 54. The first handlebar 90 is positioned over the first side 16 of the platform 14. A second handlebar 92 extends outwardly from the second support 60. The second handlebar 92 is positioned over the second side 16 of the platform 14 to permit the user to run on the running surface 24 without interference from the first handlebar 90 and the second handlebar 92. However, the first handlebar 90 and the second handlebar 92 remain conveniently positioned adjacent the user during use.

In use, the bladder 28 is filled with a granular cushioning material 26 such as sand 30. The control panel 68 is used to operate the belt assembly 20 by activating the motor 66 to move the belt 22 over the bladder 28. After or immediately prior to use, the roller assembly 44 may be passed under the bladder 28 to enhance even distribution of the granular cushioning material 26 in the bladder 28. One of both fans 70,80 may be attached to the supports 54,60 for simple cooling or to further enhance a simulation of running on the beach by providing the simulation of breezes on a beach.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A treadmill assembly comprising:

a base;

a platform coupled to said base, said platform having a first side and a second side;

a belt assembly coupled to and extending between said first side and said second side of said platform, said belt assembly including a movable belt forming a running surface adapted for supporting a user on said platform; and a flexible bladder a cushioning material contained in said flexible bladder, said bladder being positioned in said platform beneath said running surface for direct engagement with said running surface.

2. The assembly of claim 1, further including a drawer coupled to said first side of said platform, said bladder being positionable in said drawer, said drawer being slidable between an open position providing access to said bladder and a closed position wherein said bladder is positioned beneath said running surface.

3. The assembly of claim 2, further comprising:

a track coupled to said drawer, said track extending along a length of said drawer; and a roller assembly coupled to said track and extending across a bottom of said drawer, said roller assembly being movable along said track beneath said bladder to enhance even distribution of said cushioning material within said bladder.

4. The assembly of claim 3, further including a recess positioned in said bottom of said drawer, said recess extending transversely from an end of said track, said roller assembly being storable in said recess.

5. The assembly of claim 1, further including a motor operationally coupled to said belt assembly.

6. The assembly of claim 5, further comprising:

a first support having a lower end coupled to said base, said first support extending upwardly from said base; and a control panel coupled to said first support, said control panel being operationally coupled to said motor for controlling said belt assembly.

7. The assembly of claim 6, further including a first fan coupled to said first support, said first fan being adapted for directing air towards the user while the user is supported on said platform.

8. The assembly of claim 7, wherein said first fan is selectively removable from said first support.

9. The assembly of claim 7, further comprising:

a slot in a top of said first support; and a tab extending from a bottom of said first fan, said slot being insertable into said slot to support said first fan on said top of said first support in a stable position.

10. The assembly of claim 6, further comprising:

a second support extending upwardly from said base; and said control panel being coupled to said second support, said control panel extending between said first support and said second support.

11. The assembly of claim 10, further comprising:

a first handlebar extending outwardly from said first support, said first handlebar being positioned over said first side of said platform; and a second handlebar extending outwardly from said second support, said second handlebar being positioned over said second side of said platform.

12. The assembly of claim 3, further including a handle extending from a distal end of said roller assembly relative to said track, said handle being structured for positioning adjacent to a forward edge of said bladder to slide along said forward edge of said bladder to facilitate manipulation of said roller assembly to move said roller assembly in said track.

13. The assembly of claim 10, further including a second fan coupled to said second support, said second fan being adapted for directing air towards the user while the user is supported on said platform.

14. The assembly of claim 13, wherein said second fan is selectively removable from said second support.

15. The assembly of claim 13, further comprising:

a slot in a top of said second support; and a tab extending from a bottom of said second fan, said tab being insertable into said slot to support said second fan on said top of said second support in a stable position.

16. A treadmill assembly comprising:

a base;

a platform coupled to said base, said platform having a first side and a second side;

a belt assembly coupled to and extending between said first side and said second side of said platform, said belt assembly including a movable belt forming a running surface adapted for supporting a user on said platform;

a granular cushioning material contained in a flexible bladder, said bladder being positioned in said platform beneath said running surface;

a drawer coupled to said first side of said platform, said bladder being positionable in said drawer, said drawer being slidable between an open position providing access to said bladder and a closed position wherein said bladder is positioned beneath said running surface;

a track coupled to said drawer, said track extending along a length of said drawer;

a roller assembly coupled to said track and extending across a bottom of said drawer, said roller assembly being movable along said track beneath said bladder to enhance even distribution of said cushioning material within said bladder;

a handle extending from a distal end of said roller assembly relative to said track, said handle being structured for positioning adjacent to a forward edge of said bladder to slide along said forward edge of said bladder to facilitate manipulation of said roller assembly to move said roller assembly in said track;

a recess positioned in said bottom of said drawer, said recess extending transversely from an end of said track, said roller assembly being storable in said recess;

a motor operationally coupled to said belt assembly;

a first support having a lower end coupled to said base, said first support extending upwardly from said base, said first support having an angled medial section and a top;

a second support having a lower end coupled to said base, said second support extending upwardly from said base, said second support having an angled medial section and a top;

a control panel operationally coupled to said motor for controlling said belt assembly, said control panel being coupled to said first support and said second support, said control panel extending between said angled medial section of said first support and said angled medial section of said second support;

a first fan coupled to said first support, said first fan being adapted for directing air towards the user while the user is supported on said platform, first fan is selectively removable from said first support;

a slot in said top of said first support;

a tab extending from a bottom of said first fan, said tab extending from said bottom of said first fan being insertable into said slot in said top of said first support to support said first fan on said top of said first support in a stable position;

a second fan coupled to said second support, said second fan being adapted for directing air towards the user while the user is supported on said platform, said second fan being selectively removable from said second support;

a slot in said top of said second support;

a tab extending from a bottom of said second fan, said tab on said bottom of said second fan being insertable into said slot of said second support to support said second fan on said top of said second support in a stable position;

a first handlebar extending outwardly from said first support, said first handlebar being positioned over said first side of said platform; and a second handlebar extending outwardly from said second support, said second handlebar being positioned over said second side of said platform.

* * * * *